US009333440B2

(12) United States Patent
Holland et al.

(10) Patent No.: US 9,333,440 B2
(45) Date of Patent: May 10, 2016

(54) ADJUSTABLE HEIGHT HURDLE

(71) Applicant: Pro Performance Sports, L.L.C., Carlsbad, CA (US)

(72) Inventors: Allen Keith Holland, Carlsbad, CA (US); Kash Oris Bell, Carlsbad, CA (US)

(73) Assignee: PRO PERFORMANCE SPORTS, L.L.C., Carlsbad, CA (US)

( * ) Notice: Subject to any disclaimer, the term of this patent is extended or adjusted under 35 U.S.C. 154(b) by 91 days.

(21) Appl. No.: 14/460,184

(22) Filed: Aug. 14, 2014

(65) Prior Publication Data

US 2016/0045839 A1 Feb. 18, 2016

(51) Int. Cl.
*A63B 5/00* (2006.01)
*A63K 3/04* (2006.01)

(52) U.S. Cl.
CPC ..... *A63K 3/043* (2013.01)

(58) Field of Classification Search
USPC ..... 482/1–148
See application file for complete search history.

(56) References Cited

U.S. PATENT DOCUMENTS 2,706,631 A * 4/1955 Holmes ..... A63K 3/043 248/170
2,786,461 A * 3/1957 Pelsue, Jr. ..... F41B 5/12 124/25
3,055,655 A * 9/1962 Chelf ..... F41B 5/1449 124/23.1
4,129,916 A * 12/1978 Schlesinger ..... E01C 13/003 14/69.5
4,201,177 A * 5/1980 Holman ..... F41B 5/105 124/25.6
4,202,316 A * 5/1980 Barna ..... F41B 5/10 124/25.6
4,206,740 A * 6/1980 Lydon ..... F41B 5/12 124/25
4,307,880 A * 12/1981 Abram ..... A63B 21/00047 482/139
4,749,187 A * 6/1988 Dellinger ..... A63K 3/043 482/17
4,796,598 A * 1/1989 Jones ..... F41B 5/143 124/25
5,005,828 A * 4/1991 Sauerbrey ..... A63B 5/02 446/901
5,033,737 A * 7/1991 Moye ..... A63K 3/043 182/182.1
5,119,797 A * 6/1992 Anderson ..... F41B 5/143 124/24.1
5,199,930 A * 4/1993 Weber ..... A63K 3/043 108/117
5,433,186 A * 7/1995 Corwin ..... F41B 5/1449 124/1
5,649,520 A * 7/1997 Bednar ..... F41B 5/12 124/25
6,695,707 B1 * 2/2004 Fernandez ..... A63C 19/10 14/69.5
6,968,834 B1 * 11/2005 Gibbs ..... F41B 5/1449 124/1
7,438,668 B1 * 10/2008 Watry ..... A63K 3/043 403/109.3
7,611,442 B1 * 11/2009 Myrland ..... A63K 3/043 482/15
7,635,319 B2 * 12/2009 Dieter ..... A63B 5/02 482/129
8,029,412 B2 * 10/2011 Dieter ..... A63K 3/043 482/129
8,313,417 B2 * 11/2012 Dieter ..... A63K 3/043 482/129
8,517,898 B2 * 8/2013 Dieter ..... A63K 3/043 482/129

OTHER PUBLICATIONS

Champion Sports, Adjustable Training Hurdle, www. amazon.com (Jan. 1, 2013).
Terrazign Product Design, SPARQ Speed Hurdle, www.terrazign.com/projects.php (Jan. 1, 2013).
SKLZ, Adjustable-Height Hurdles, www.shop.sklz.com (Jan. 1, 2013).

* cited by examiner

*Primary Examiner* — Stephen Crow
(74) *Attorney, Agent, or Firm* — Squire Patton Boggs (US) LLP

(57) ABSTRACT

An adjustable height hurdle may have a rigid base with a slider movable on or in a track to different base length positions. A flexible bridge may have a first end attached to the slider and a second end attached to the track. The bridge is movable from an erect position wherein the bridge is on a top side of the base and the hurdle has an isosoles trapezoid shape, to a collapsed position wherein the bridge is on a bottom side of the base. The height of the hurdle is adjusted by changing the length of the base.

20 Claims, 5 Drawing Sheets

ADJUSTABLE HEIGHT HURDLE

BACKGROUND OF THE INVENTION

Hurdles are used in athletic training and competition for sports activities combining running and jumping. The objective in hurdling is to clear the hurdles in minimum time. Hurdling requires running speed, jumping ability, as well as a high level of coordination to allow the hurdler to properly set strides and launch properly timed jumps to clear the hurdles. Novice hurdlers often step on or trip over a hurdle. Consequently, hurdles that easily tip over, break away or bend away have been proposed. These types of designs have met with varying degrees of success, as disadvantages remain. Improved designs are needed.

SUMMARY OF THE INVENTION

An adjustable height hurdle may have a rigid base with a slider movable on or in a track to different base length positions. A flexible bridge may have a first end attached to the slider and a second end attached to the track. The bridge is movable from an erect position wherein the bridge is on a top side of the base and the hurdle generally has an isosoles trapezoid shape, to a collapsed position wherein the bridge is on a bottom side of the base. The height of the hurdle may be adjusted by changing the length of the base.

BRIEF DESCRIPTION OF THE DRAWINGS

In the drawings the same element number indicates the same element in each of the views.

DETAILED DESCRIPTION OF THE DRAWINGS

Figure 1:
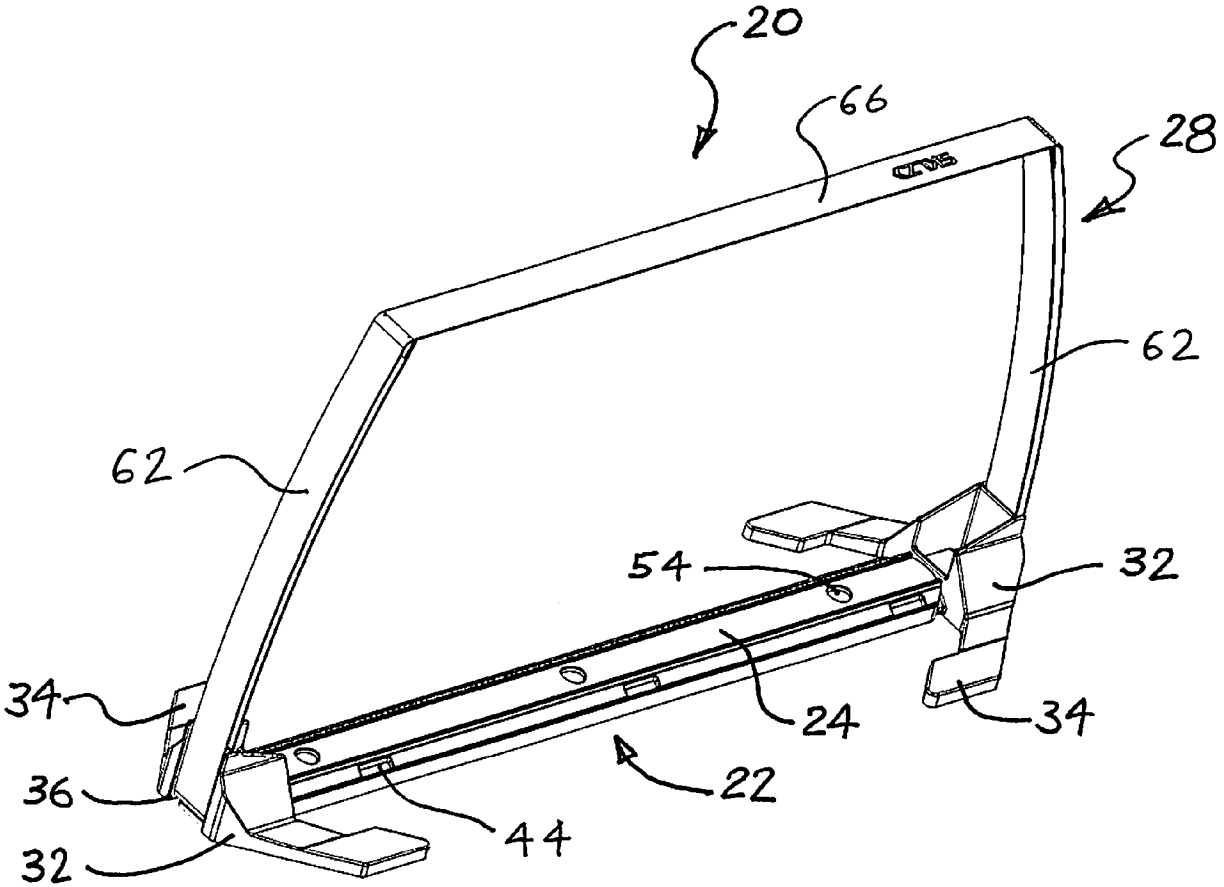
FIG. 1 is a top perspective view of an adjustable height hurdle in the erect position and ready for use.
Figure 3:
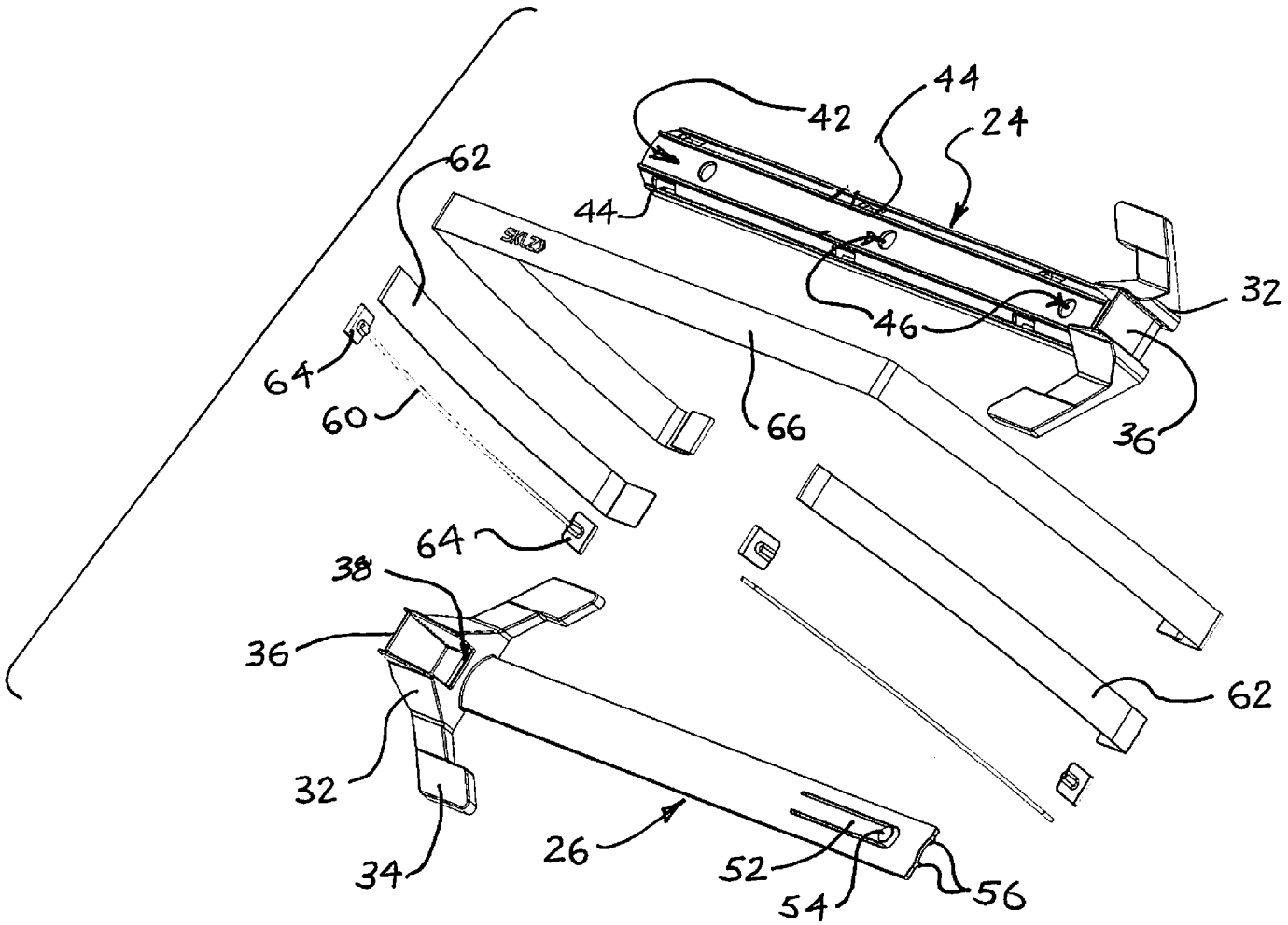
FIG. 3 is an exploded perspective view of the hurdle of FIG. 1.

As shown in FIG. 1, a hurdle 20 includes a base 22 and a bridge 28. In the erect position as shown in FIG. 1 where the hurdle 20 is ready for use, the hurdle may have a generally isosoles trapezoid shape, with the base 22 forming the longer base of the trapezoid, and with the bridge 28 forming the legs and the shorter or top base of the trapezoid. Referring now also to FIG. 3, the base 22 may include a slider 26 that is movable or slidable on or in a track 24, to change the length of the base 22.

A stand 32 may be attached to the outer end of each of the slider 26 and the track 24. The two stands 32 as shown in FIG. 1 may be the same. The stand 32 may have legs 34 extending outwardly to the side of the base. In the example shown, each stand 32 has two legs 34 extending inwardly (towards a center of the base) with the legs forming an acute angle with the axis AA of the base 22 shown in FIG. 2. The legs 34, if used, may also extend outwardly or be perpendicular to the axis AA of the base 22. The bottom side of the stand 32 may be flat, or have ribs or gussets in a flat plane, so that the stand may sit flat or flush against a ground surface such as pavement or grass. The legs 34 may be omitted and replaced with a plate. In some designs, with or without legs 34, a spike or stake may be used on the stand 32 to hold the stand down onto grass, sand, or other penetrable ground surface.

The length of the base 22 is adjustable. Various designs may be used for this purpose such as by using sliding elements or telescoping elements, or by direct placement of attachable elements, such as detach-move-attach elements that do not slide. For example, a non-sliding design may use two base elements having interlocking fittings that snap together, or a design using two base elements that are simply overlapped and clamped to achieve a desired base length.

The example shown uses a sliding design having a slider 26 that telescopically slides into and out of a track 24. As shown in FIG. 3, a track slot 42 may be provided on a bottom surface of the track 24, with the slider 26 slidable in the track slot 42. Track guides 44 may be used to hold the slider 26 into the track slot 42, while allowing the slider 26 to slide. The track 24 may have position holes 46. The inner end of the slider 26 may have a slider button 54 on a spring finger 52 urging the slider button up. The slider button 54 pops up through a position hole 46 when it comes into alignment with a position hole, as the slider 26 is moved in or out relative to the track 24.

Figure 2:
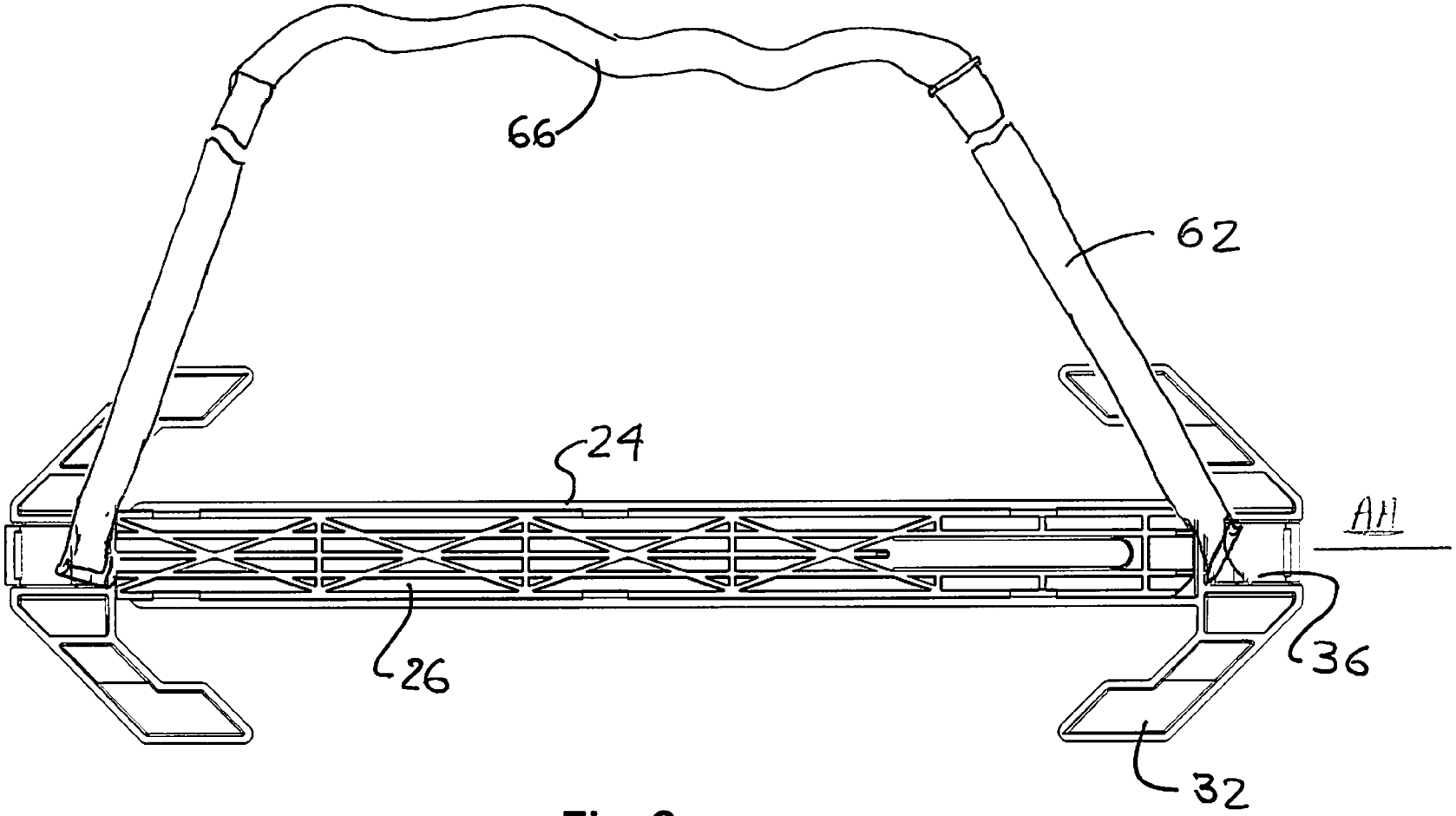
FIG. 2 is a bottom perspective view of the hurdle of FIG. 1 in a collapsed position for storage or transport.

As shown in FIGS. 2 and 3, the bottom of the slider 26 and the bottom of the bridge 28 may have stiffening ribs and gussets 56 to help reduce bending of the base 22, especially if the base 22 is made of lightweight plastic. The top surface of the track 24 and of the slider 26 may be concave or curving down at the lateral edges to reduce interference with the hurdler if the hurdler steps on the base 22.

Referring to FIGS. 2 and 3, the bridge 28 may be described as having left and right spring sections 62 joined to a central tension section 66. The left and right spring sections 62 may be the same. The left and right spring sections 62 may have a spring element 60. In the example shown the spring element 60 may be a flexible rod, such as a plastic or fiberglass rod, or an element which can bend or flex over its entire length. Other forms of spring element including metal spring elements, and spring elements having other shapes, such as flat strips, may also be used. The flexible rod may be contained within a fabric sleeve or cover, with rod caps 64 at the upper and lower ends of the flexible rod used to distribute spring force and to hold the sleeve into a generally rectangular strip.

In FIG. 3, the spring element in the form of the rod 60 extends substantially over the entire length of the spring section 62. However, in alternative designs the spring section 62 may be rigid, with a lower end of the spring section 62 biased upwardly away from the base 22 by one or more springs on the base, such as a coil spring. A molded in plastic spring may also be used to bias the spring section 62.

The tension section 66 may be a fabric or plastic strip, braid or rope, as it is tensioned by the spring sections 62 and requires no additional elements. The tension section 66 may be provided as a fabric strip having the same width as the spring section 62. Referring momentarily to FIG. 2, with the hurdle 20 in the collapsed position, the tension section 66 may be limp so that it can be folded, coiled or bunched up into a compact size. The spring sections 62 on the other hand may have either a rigid element or a spring element, so that the spring sections can hold up the tension section as shown in FIG. 1.

The entire bridge 28, which includes the spring sections 62 and the tension section 66, may be provided as fabric strip, with the spring elements 60 stitched in place within the fabric strip. The ends of the fabric strip may be attached to the bottom of the base 22. Alternatively the fabric strip may be attached to the top of the base 22 and routed through a bridge slot 38 at each end of the base 22, with a fold or loop stitched into the end of the fabric strip to prevent the fabric strip from pulling back out from the bridge slot 38.

Figure 5:
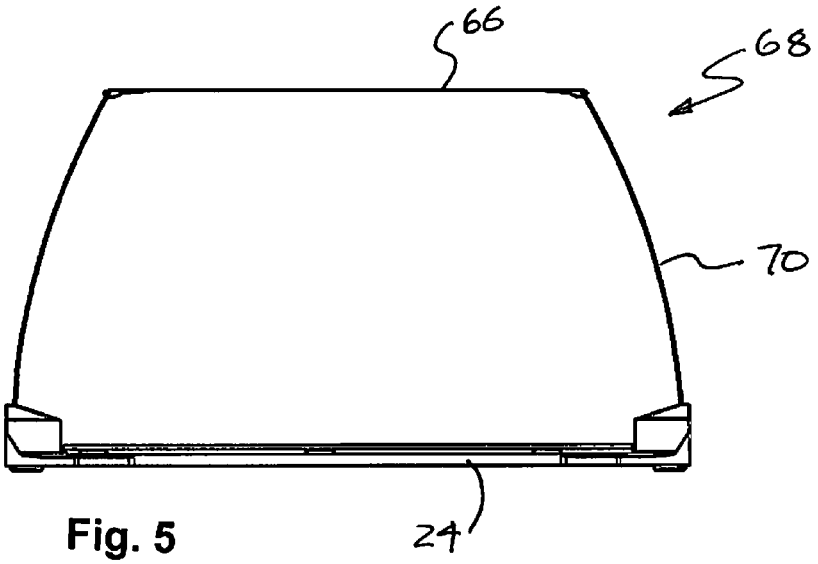
FIG. 5 is a front view of the hurdle of FIG. 4 in a high position.

Each stand 32 may have an angle surface 36 with the lower end of the spring section 62 lying against the angle surface. The angle surface 36 may be perpendicular to the bottom surface of the stand, or it may be inclined inwardly at an angle up to about 30 degrees. With the hurdle 20 in the erect position as shown in FIGS. 1 and 5, the spring sections 62 may be flexed or arced slightly inwardly, with the spring sections 62 tensioning the tension section 66 via spring force. The tension section 66 is pulled tight into a substantially flat and horizontal position. In the erect position shown in FIG. 1, the hurdle 20 is in the form of a trapezoid, although the spring sections 62 forming the legs of the trapezoid, are typically curved inwardly.

If a hurdler steps on the tension section 66, the spring sections 62 can bend much further inwardly, allowing the tension section 66 to be deflected all of the way to the base or the ground, providing less interference with the hurdler's movement. If the hurdler's foot catches on the tension section 66 in the forward direction, the spring sections 62 can bend forward, for the same purpose. The base 22 and bridge 28 may be made of lightweight materials, allowing the hurdle 20 to be easily tipped over upon contact with a hurdler's foot to also reduce interfering with the hurdler. For example, the base 22 including the track 24, the slider 28 and the stands 32, if used, may be molded plastic, the spring element 60 may be a small diameter rod, and the bridge 28 may be fabric or plastic sleeve.

Figure 4:
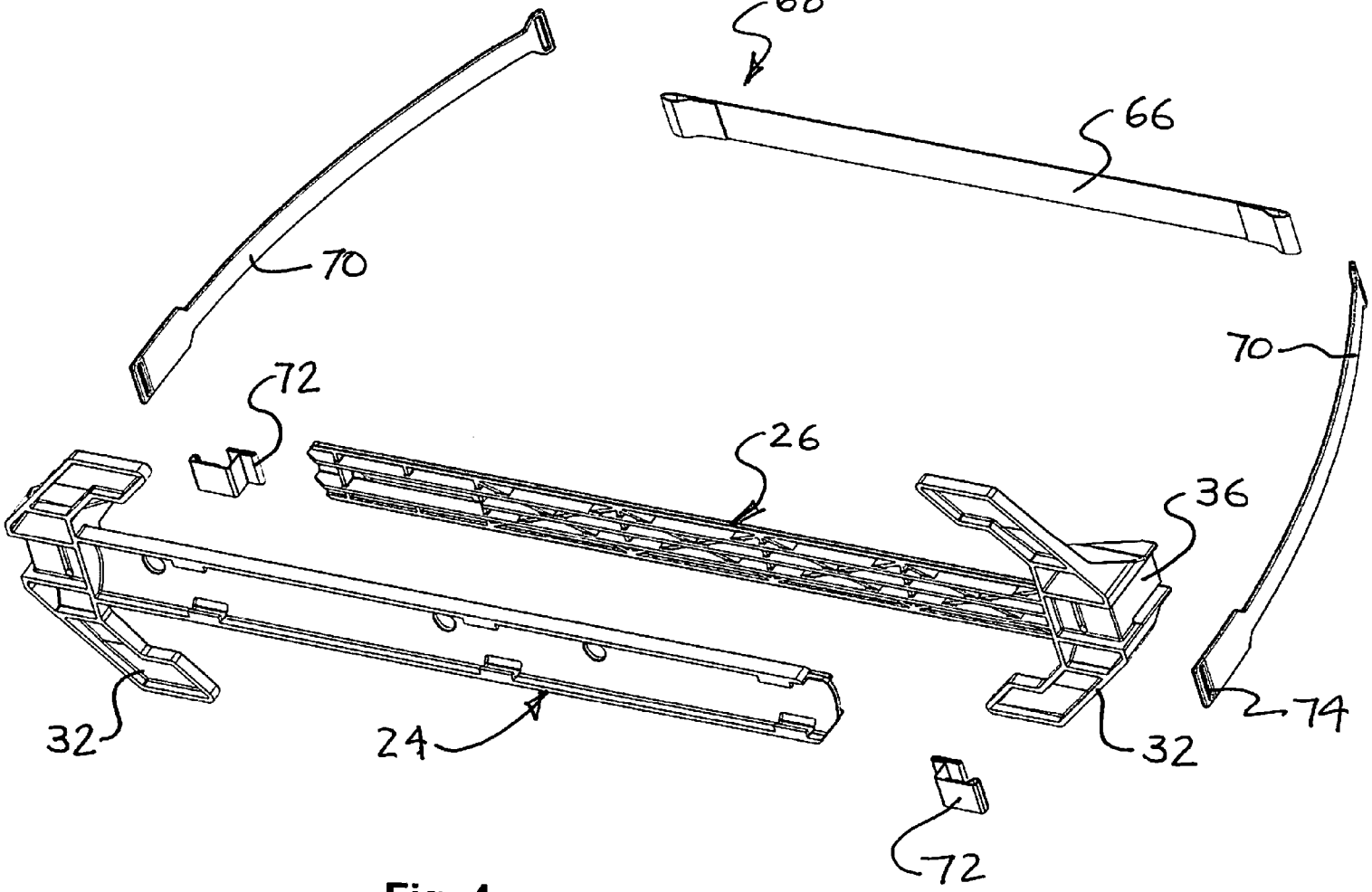
FIG. 4 is an exploded perspective view of a second embodiment.

FIG. 4 shows a second embodiment 68 which may be the same as the first embodiment except that the flex rod 60 and sleeve 62 are replaced with an optionally single piece solid flex arm 70, which may be plastic, metal, fiberglass, or a similar material having spring or flex characteristics. The left and right flex arms 70 may be attached to the track 24 and the slider 26 via clips 72. The clip may snap into the bottom of the stand 32. A loop on the clip may extend through a slot 74 at the lower end of each flex arm 70.

FIGS. 1 and 5 show the hurdle 20 or 68 at a high position. In this position, the base is e.g., 46-66 cm (18-26 inches) and nominally 56 cm (22 inches) wide and the tension section 66 is 25-36 cm (10-14 inches) and nominally 30 cm (12 inches) above the ground, for a height/width ratio of about 0.5.

Figure 6:
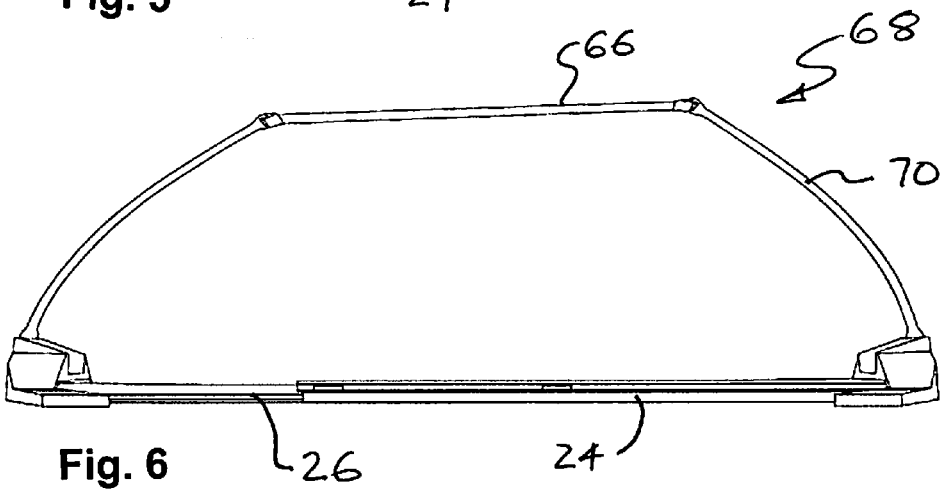
FIG. 6 is a front view of the hurdle of FIG. 4 is an intermediate position.

To lower the height of the tension section 66, the length of the base 22 is increased. This causes the spring sections 62 or arms 70 to bend in further and lower. In the example shown the base 22 may be lengthened by pressing the slider button 54 down and sliding the slider 26 out from the track 24 until the slider button 54 engages a next outer positioning hole 46. FIG. 6 shows the hurdle 20 or 68 in an intermediate position where the base is e.g., 60-86 cm (24-34 inches) and nominally 74 cm (29 inches) wide and the tension section 66 is 18-28 cm (7-11 inches) and nominally 23 cm (9 inches) above the ground, for a height/width ratio of about 0.3. Other intermediate positions may also be provided by providing more position holes 46 in the track 24.

Figure 7:
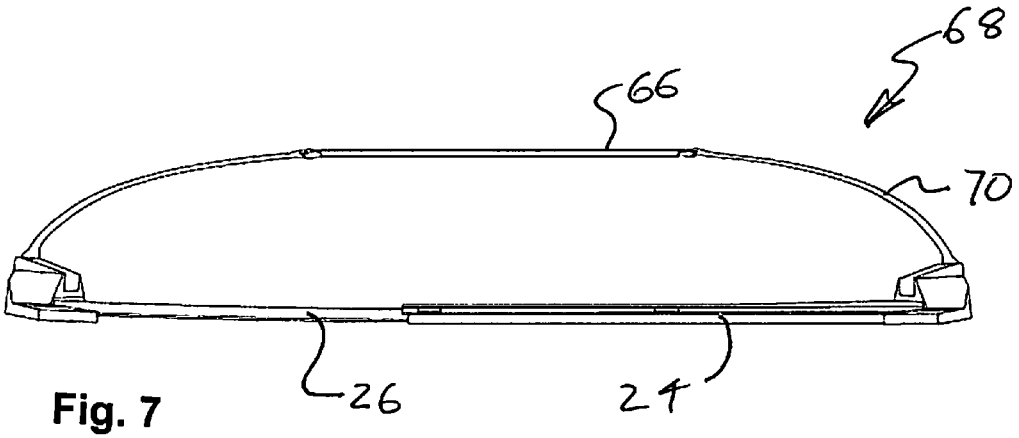
FIG. 7 is a front view of the hurdle of FIG. 4 in a low position.

FIG. 7 shows the hurdle 20 or 68 in a low position where the base is e.g., 79-104 cm (31-41 inches) and nominally 91 cm (36 inches) wide and the tension section 66 is 13-18 cm (5-7 inches) and nominally 15 cm (6 inches) above the ground, for a height/width ratio of about 0.17. The hurdle 20 or 68 may provide height to width ratios ranging from about 0.15 to 0.6 or 0.7.

The hurdle 20 may be reconfigured from the erect position shown in FIG. 1 to the folded position shown in FIG. 2 by leaning the bridge 28 towards either stand 32, pulling the spring section 62 off of the angle surface 36 and flipping the spring section 62 over to the back side of the base 22, and then repeating these steps at the other end of the hurdle 20. The bridge 28 is then un-tensioned. The spring sections 62 may be folded flat onto the back of the base 22 with the tension section folded back on itself or bunched up. The hurdle 20 then is in a flat and compact configuration, with the height and width of the hurdle in this configuration determined by the height and width of the stand 32, when used, with the length determined by the length of the base 22 when set at the minimum length.

Although the length of the base is typically made to be adjustable, a simplified hurdle design may also be used with the bridge elements described above and with a base having a fixed length. In this case the base may simply be a fixed length of rigid material such as metal or plastic, with no slider or track needed or used. In this design, the fixed length base may include one or more hinges to allow the fixed length base to fold up for storage.

Thus, a novel hurdle has been shown and described. Various changes and substitutions may be made without departing from the spirit and scope of the invention. The invention, therefore, should not be limited except to the following claims and their equivalents.

The invention claimed is:

1. A hurdle comprising:

a base having a first end and a second end, and an adjustable length;

a first stand at the first end and a second stand at the second end of the base;

a bridge having a tension section, a first spring section and a second spring section, with the first spring section having a lower end attached to the first stand and an upper end attached to a first side of the tension section, and the second spring section having a lower end attached to the second stand and an upper end attached to a second side of the tension section;

with the bridge movable from an erect position wherein the bridge is on a top side of the base with the first and second spring sections tensioning the tension section, to a folded position where the first and second spring sections are on a bottom side of the base and the tension section is un-tensioned.

2. The hurdle of claim 1 with the base comprising a slider movable on or in a track to a plurality of base length positions, wherein the base and the slider are both substantially rigid.

3. The hurdle of claim 2 with the slider movable telescopically into and out of the track.

4. The hurdle of claim 2 with the base extendible by at least 30 cm by sliding the base relative to the slider.

5. The hurdle of claim 1 with the tension section comprising a flexible band of material.

6. The hurdle of claim 5 with the bridge comprising a flexible band of material with a first spring element in the first spring section and a second spring element in the second spring section.

7. The hurdle of claim 1 with the bridge and the base forming a trapezoid when the hurdle is in the erect position.

8. The hurdle of claim 1 with each stand having a channel surface and a bottom surface at an acute angle to the bottom surface.

9. The hurdle of claim 8 with the acute angle ranging from 49 to 89 degrees.

10. The hurdle of claim 2 with a spacing between the base and the tension section decreasing as the ends of the base are moved away from each other.

11. A hurdle comprising:

a rigid base having a slider movable on or in a track to a plurality of base length positions;

a flexible bridge having a first end attached to the slider and a second end attached to the track;

with the bridge movable from an erect position wherein the bridge is on a top side of the base and the hurdle has an isosoles trapezoid shape, to a collapsed position wherein the bridge is on a bottom side of the base.

12. The hurdle of claim 11 with the bridge having left and right spring elements at its left and right ends and a fabric center section.

13. The hurdle of claim 11 with the track having a convex top surface, and with the slider telescopically moveable into and out of the track to adjust the length of the base.

14. The hurdle of claim 12 with the left and right ends of the bridge permanently attached to opposite ends of the base, and with the spring elements alignable alongside and parallel to the track when the hurdle is in the collapsed position.

15. The hurdle of claim 12 with the bridge comprising a fabric strip having left, center and right sections, and with the left and right spring elements enclosed within the left and right sections of the fabric strip.

16. The hurdle of claim 15 with the left and right spring elements comprising a flexible rod having top and bottom end caps.

17. The hurdle of claim 11 further comprising a slider angle surface on the slider and a track angle surface on the track, and with the bridge having a flexible left section against the slider angle surface and a flexible right section against the track angle surface, when the hurdle is in the erected position.

18. The hurdle of claim 11 with the bridge forming the legs and short base of the trapezoid.

19. The hurdle of claim 11 further including a slide lock for locking the slider at a fixed position relative to the track.

20. The hurdle of claim 11 further comprising a slider stand on the slider and a track stand on the track, with the slider stand having legs extending inwardly towards the track stand, and with the slider stand a mirror image of the track stand.

* * * * *